US009236018B2

(12) United States Patent
Nakanishi et al.

(10) Patent No.: US 9,236,018 B2
(45) Date of Patent: Jan. 12, 2016

(54) REDUCING DETERIORATION IN DISPLAY QUALITY OF A DISPLAYED IMAGE ON A DISPLAY DEVICE

(71) Applicant: PANASONIC LIQUID CRYSTAL DISPLAY CO., LTD., Hyogo (JP)

(72) Inventors: Hideyuki Nakanishi, Osaka (JP); Yoshihisa Ooishi, Osaka (JP); Sachiko Yamazaki, Osaka (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 3 days.

(21) Appl. No.: 14/175,633

(22) Filed: Feb. 7, 2014

(65) Prior Publication Data

US 2014/0225877 A1 Aug. 14, 2014

(30) Foreign Application Priority Data

Feb. 8, 2013 (JP) ..... 2013-023057

(51) Int. Cl.
*G09G 3/36* (2006.01)

(52) U.S. Cl.
CPC ..... *G09G 3/3648* (2013.01); *G09G 3/3677* (2013.01); *G09G 2310/0213* (2013.01); *G09G 2320/0247* (2013.01); *G09G 2340/0435* (2013.01)

(58) Field of Classification Search
CPC ..... G09G 2310/0227; G09G 2310/0213; G09G 2320/0247; G09G 2340/0435; G09G 3/3677; G09G 3/3648
USPC ..... 345/102, 211
See application file for complete search history.

(56) References Cited

U.S. PATENT DOCUMENTS

| | | | | |
|---|---|---|---|---|
| 5,712,652 | A * | 1/1998 | Sato et al. | 345/90 |
| 5,844,534 | A * | 12/1998 | Okumura et al. | 345/90 |
| 5,990,860 | A * | 11/1999 | Takeuchi | 345/667 |
| 6,762,743 | B2 * | 7/2004 | Yoshihara et al. | 345/102 |
| 6,937,224 | B1 * | 8/2005 | Miyachi | 345/102 |
| 7,212,193 | B2 * | 5/2007 | Ueda | 345/204 |
| 7,352,350 | B2 * | 4/2008 | Nitta et al. | 345/94 |
| 7,808,461 | B2 * | 10/2010 | Yamazaki et al. | 345/82 |
| 2003/0010894 | A1 * | 1/2003 | Yoshihara et al. | 250/208.1 |

(Continued)

FOREIGN PATENT DOCUMENTS

| | | | |
|---|---|---|---|
| JP | 06-222330 | A | 8/1994 |
| JP | 08-313869 | A | 11/1996 |

(Continued)

*Primary Examiner* — Lun-Yi Lao
*Assistant Examiner* — Kelly B Hegarty
(74) *Attorney, Agent, or Firm* — McDermott Will & Emery LLP

(57) ABSTRACT

A display device includes a display portion having gate and source signal lines, and a plurality of pixels, a gate driver that outputs gate signals, a source driver that outputs source signals, and a controller that causes the display portion to display an image at a frame frequency. The controller sets the frame frequency to a first frame frequency F1 when the image is a moving picture, and the controller sets the frame frequency to a second frame frequency F2 lower than F1 when the image is a still picture. The gate driver outputs the gate signals to the gate signal lines in an aligned order of gate signal lines in a second direction when the frame frequency is F1, and the gate driver outputs the gate signals to the gate signal lines in different order from the array order when the frame frequency is F2.

11 Claims, 12 Drawing Sheets

(56) References Cited

U.S. PATENT DOCUMENTS

| | | | | |
|---|---|---|---|---|
| 2005/0253798 | A1* | 11/2005 | Hiyama et al. | 345/98 |
| 2007/0057900 | A1* | 3/2007 | Huang | 345/102 |
| 2007/0103408 | A1* | 5/2007 | Tada et al. | 345/76 |
| 2009/0244112 | A1* | 10/2009 | Jung et al. | 345/691 |
| 2011/0032231 | A1* | 2/2011 | Maruyama et al. | 345/208 |
| 2011/0298768 | A1* | 12/2011 | Yeo et al. | 345/208 |
| 2013/0038621 | A1* | 2/2013 | Choi et al. | 345/589 |
| 2014/0022220 | A1* | 1/2014 | Lee et al. | 345/204 |

FOREIGN PATENT DOCUMENTS

| | | | |
|---|---|---|---|
| JP | 2003-280578 | A | 10/2003 |
| JP | 2006-064964 | A | 3/2006 |
| JP | 2009-180855 | A | 8/2009 |

* cited by examiner

REDUCING DETERIORATION IN DISPLAY QUALITY OF A DISPLAYED IMAGE ON A DISPLAY DEVICE

RELATED APPLICATIONS

This application claims the benefit of Japanese Application No. 2013-023057, filed on Feb. 8, 2013, the disclosure of which Application is incorporated by reference herein.

TECHNICAL FIELD

The present disclosure relates to a display device including a display portion that displays frame images.

BACKGROUND

A liquid crystal display device or the like is used as the display device of high resolution color monitors of computers and other information equipment, or television receivers. The liquid crystal display device fundamentally includes a display portion in which liquid crystals are sandwiched between two substrates at least one of which is made of transparent glass or the like. In addition, the liquid crystal display device includes a driver for selectively applying voltages to pixel electrodes formed on the substrate of the display portion. Pixels of the respective pixel electrodes are controlled based on voltage application by the driver.

The display portion generally includes a plurality of gate signal lines, a plurality of source signal lines, and a plurality of pixel electrodes. The gate signal lines, for instance, extend in a horizontal direction (main scanning direction), and are aligned in a vertical direction (sub scanning direction). The source signal lines, for instance, extend in the vertical direction (sub scanning direction), and are aligned in the horizontal direction (main scanning direction). A plurality of thin film transistors (TFTs) and the pixel electrodes are disposed in a matrix at intersection points of the gate signal lines and the source signal lines. The gate driver outputs voltages (gate signals) to the gate signal lines for turning on and off the TFTs. Moreover, the source driver outputs voltages (source signals) based on an input image signal to the pixel electrodes via the source signal lines, thereby controlling transmittance of the liquid crystals provided corresponding to the pixel electrodes to values according to the source signals.

In the display device, for instance, based on the external input image signal, frame images displayed on the display portion are sequentially switched to display a smooth image on the display portion. For a frame frequency, which is a frequency at which the frame images are switched, 60 Hz is generally used. JP-A-2003-280578 describes a display device that detects whether the input image signal is a signal representing a still picture or a moving picture and switches a frame frequency in accordance with a detection result. In the device described in JP-A-2003-280578, when the input image signal represents a still picture, the frame frequency is lowered to reduce power consumption at the time of image display.

The source signals based on the input image signal are applied to the pixel electrodes while the gate signals are on. When the gate signals are turned off, ideally, voltages applied to the pixel electrodes are maintained, so that brightness of the pixels is kept at a certain value. However, since the voltages can leak from the pixel electrodes, the brightness of the pixels decreases while the gate signals are off.

FIG. 8 is a diagram schematically showing the pixel corresponding to the gate signal line in a display screen. FIG. 9 is a timing chart schematically showing the brightness of the pixel when the frame frequency is 60 Hz. FIG. 10 is a timing chart schematically showing the brightness of the pixel when the frame frequency is 15 Hz.

The brightness of a pixel P corresponding to a gate signal line Gb in a display screen 120 shown in FIG. 8 fluctuates, as shown in FIGS. 9 and 10. When the frame frequency is 60 Hz, which is relatively high, a fluctuation range of the brightness is small, as shown in FIG. 9. Accordingly, flicker caused by the fluctuation of the brightness may be inconspicuous. On the other hand, when the frame frequency is 15 Hz, which is low, the fluctuation range of the brightness is larger than the case of FIG. 9, as shown in FIG. 10. Accordingly, the flicker caused by the fluctuation of the brightness may be conspicuous.

In general, in the display device, the gate signals are outputted to the gate signal lines in array order of the gate signal lines, for instance, from the gate signal line at an upper end to the gate signal line at a lower end. In the above-described display device, when the frame frequency is lowered, there are a method of expanding a vertical blanking period and a method of providing a horizontal blanking period.

FIG. 11 is a timing chart schematically showing the gate signals and the brightness when the frame frequency is lowered by expanding the vertical blanking period. In FIG. 11, section (A) indicates gate signals of gate signal lines G1 to G16, and section (B) indicates the brightness of the pixels of the gate signal lines G1 to G4, and section (C) indicates the brightness of the pixels of the gate signal lines G9 to G12.

As shown in section (A) of FIG. 11, a vertical blanking period V0 when the frame frequency is 60 Hz is expanded to V1, thereby lowering the frame frequency to 15 Hz. In this case, as shown in sections (B) and (C) of FIG. 11, the brightness of the whole display screen rises in a period in which the gate signals are outputted, and the brightness of the whole display screen gradually decreases in the subsequent vertical blanking period V1. Accordingly, flicker in the whole display screen occurs.

FIG. 12 is a timing chart schematically showing the gate signals and the brightness when the frame frequency is lowered by providing the horizontal blanking period. In FIG. 12, section (A) indicates the gate signals of the gate signal lines G1 to G16, and section (B) indicates the brightness of the pixels of the gate signal lines G1 to G4, and section (C) indicates the brightness of the pixels of the gate signal lines G9 and G10.

As shown in section (A) of FIG. 12, a horizontal blanking period H1 is provided to thereby lower the frame frequency to 15 Hz. In this case, as shown in sections (B) and (C) of FIG. 12, the brightness of the gate signal lines G1 to G16 rises at regular intervals sequentially from top, and then gradually decreases. Accordingly, flicker occurs so as to sequentially ripple from top to bottom of the display screen.

As described above, when the frame frequency is lowered, whichever method of expanding the vertical blanking period or providing the horizontal blanking period is used, the flicker occurs, so that display quality of an image displayed on the display portion is deteriorated.

SUMMARY

In one general aspect, the instant application describe a display device that includes a display portion having a plurality of gate signal lines extending in a first direction and aligned in a second direction intersecting the first direction, a plurality of source signal lines extending in the second direction and aligned in the first direction, and a plurality of pixels connected to the source signal lines and the gate signal lines. The display portion is configured to display an image at a frame frequency for each frame. The display device further includes a gate driver configured to output gate signals to the gate signal lines sequentially and a source driver configured to output source signals to the pixels connected to the gate signal lines to which the gate signals are outputted, the source signals configured to display the image through the source signal lines. The display device further includes a controller configured to control the gate driver and the source driver to cause the display portion to display the image at the frame frequency for each frame. The controller sets the frame frequency to a first frame frequency F1 when the image is a moving picture, and the controller sets the frame frequency to a second frame frequency F2 lower than the first frame frequency F1 when the image is a still picture. The gate driver outputs the gate signals to the gate signal lines in the aligned order of the gate signal lines in the second direction when the frame frequency is the first frame frequency F1. The gate driver outputs the gate signals to the gate signal lines in a different order from the aligned order when the frame frequency is the second frame frequency F2.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. Reference now is made in detail to the examples illustrated in the accompanying drawings and discussed below.

Figure 1:
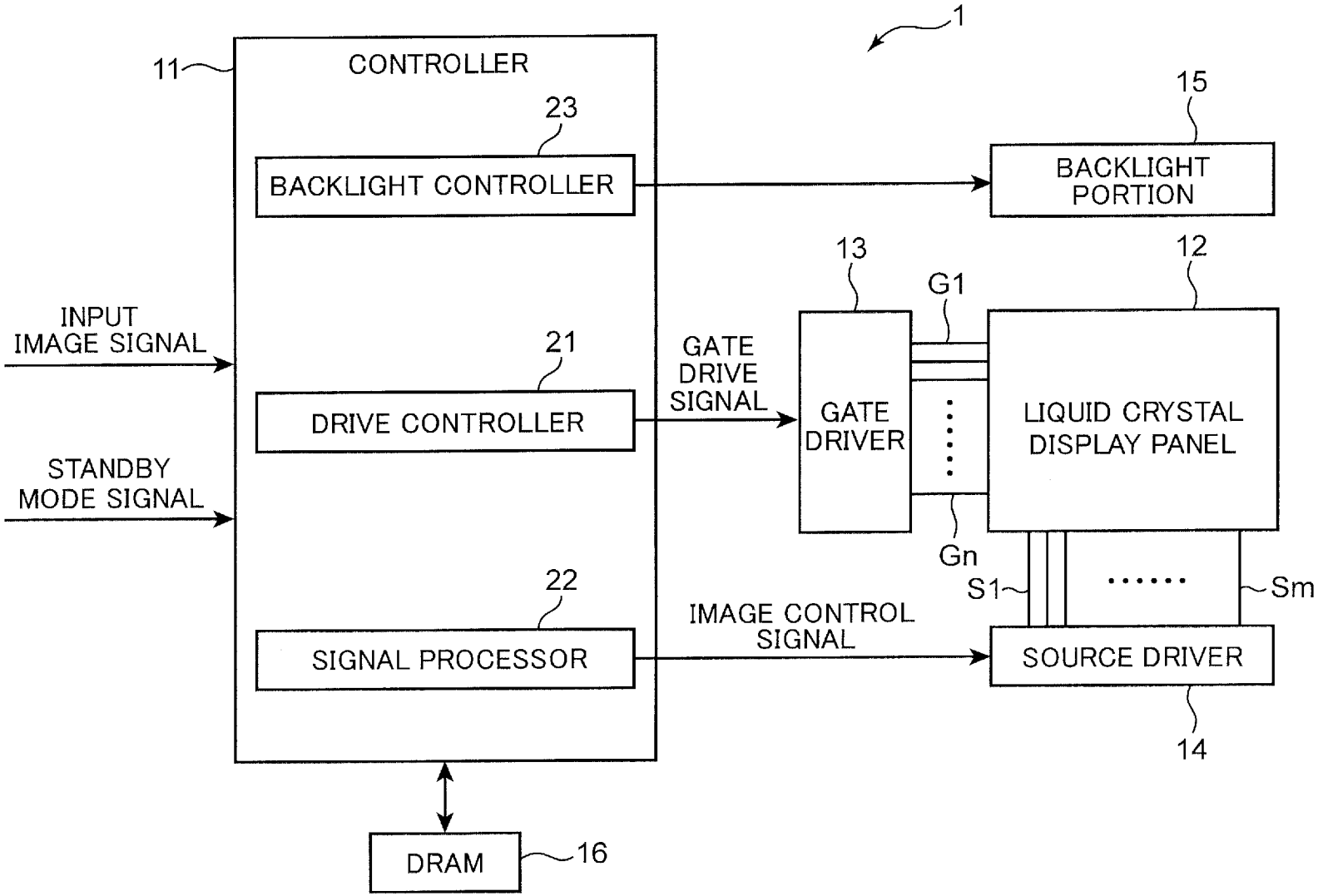
FIG. 1 is a block diagram showing a configuration of a display device of one implementation of the present application.
Figure 2:
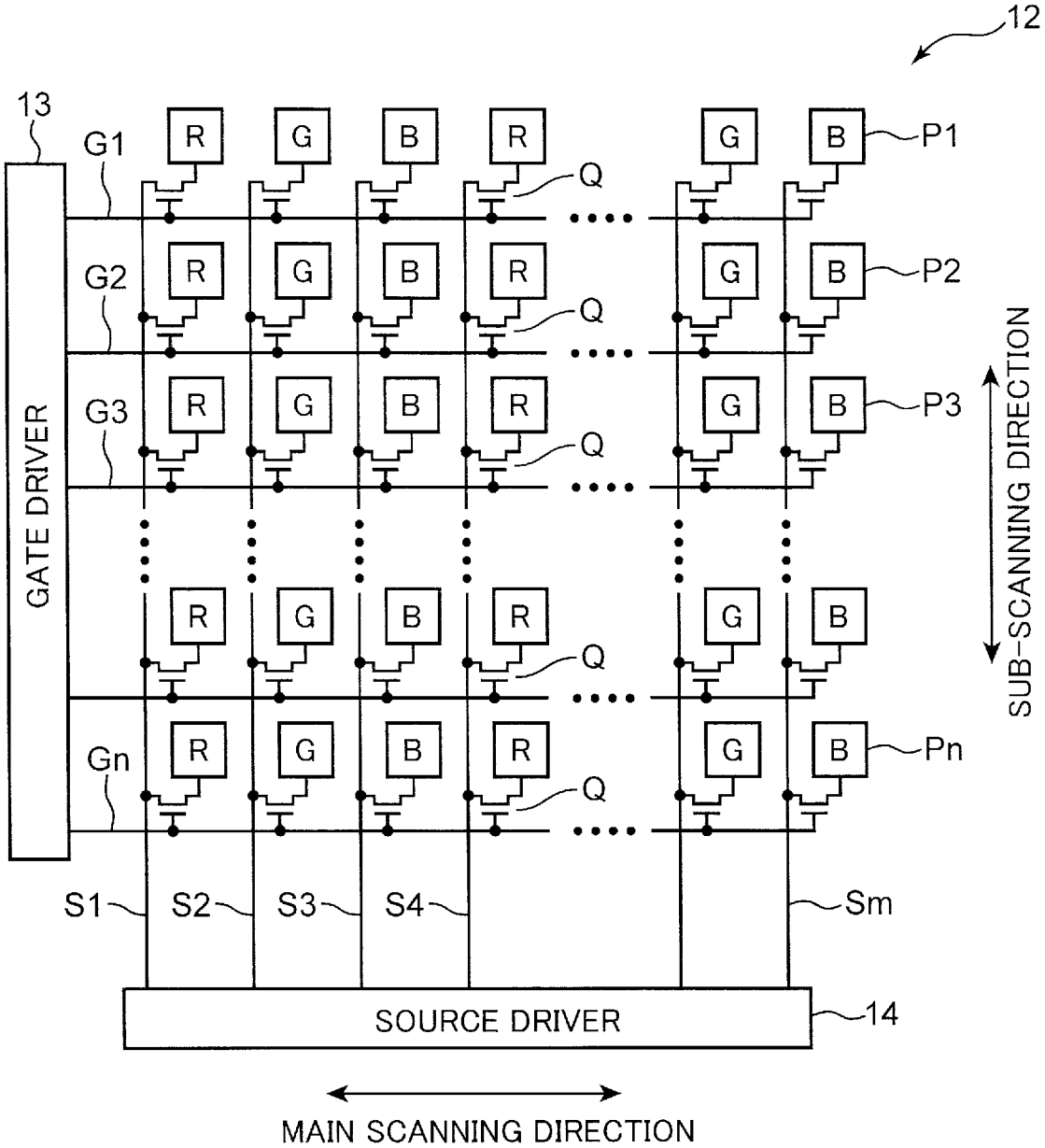
FIG. 2 is a circuit diagram showing a connection state of signal lines of a liquid crystal display panel shown in FIG. 1.

FIG. 1 is a block diagram showing a configuration of a display device of one implementation of the present application. FIG. 2 is a circuit diagram showing a connection state of signal lines of a liquid crystal display panel shown in FIG. 1.

As shown in FIG. 1, a display device 1 includes a controller 11, a liquid crystal display panel 12, a gate driver 13, a source driver 14, a backlight portion 15, and a dynamic random access memory (DRAM) 16. The controller 11 includes a drive controller 21, a signal processor 22, and a backlight controller 23.

The liquid crystal display panel 12 includes a plurality of source signal lines S1, S2, . . . , Sm, a plurality of gate signal lines G1, G2, . . . , Gn, a plurality of thin film transistors Q, and a plurality of pixel electrodes R, G, B (i.e., red pixel electrodes R, green pixel electrodes G, and blue pixel electrodes B), as shown in FIG. 2. The source signal lines S1, S2, . . . , Sm extend in a vertical direction (sub scanning direction), and are aligned in a horizontal direction (main scanning direction). The gate signal lines G1, G2, . . . , Gn extend in the horizontal direction (main scanning direction), and are aligned in the vertical direction (sub scanning direction). The thin film transistors Q and the pixel electrodes R, G, B are disposed in a matrix at intersection points of the source signal lines S1, S2, . . . , Sm, and the gate signal lines G1, G2, . . . , Gn.

The backlight portion 15 has a light source to illuminate the liquid crystal display panel 12 from a back surface of the liquid crystal display panel 12. A lighting method of either an edge lighting type or a direct lighting type may be applied to the backlight portion 15.

The controller 11 controls the gate driver 13 and the source driver 14 and applies, once for each frame, voltages corresponding to an input image signal to the pixel electrodes R, G, B disposed in a matrix of the liquid crystal display panel 12. That is, the controller 11 writes, once for each frame, image data in the pixels (liquid crystals) of the pixel electrodes R, G, B disposed in a matrix of the liquid crystal display panel 12.

The input image signal and a standby mode signal are externally inputted to the controller 11. The standby mode signal inputted to the controller 11 is turned on when the input image signal is switched from a signal representing a moving picture to a signal representing a still picture. Moreover, the standby mode signal inputted to the controller 11 is turned off when the input image signal is switched from the signal representing the still picture to the signal representing the moving picture. The controller 11 performs control in a standby mode when the standby mode signal is turned on, and performs control in a normal mode when the standby mode signal is turned off.

The controller 11 repeats image generation of one frame at a first frame frequency F1 (in the present implementation, for instance, F1=60 Hz) in the normal mode. This allows a moving picture displayed on the liquid crystal display panel 12 to be visually recognized by a viewer. When the standby mode signal is turned on, the controller 11 stores the input image signal (frame image) at this time in the DRAM 16. The controller 11, in the standby mode, repeats the image generation of one frame at a second frame frequency F2 (in the present implementation, for instance, F2=15 Hz), using the image signal stored in the DRAM 16. This allows a still picture displayed on the liquid crystal display panel 12 to be virtually recognized by the viewer.

The drive controller 21 outputs a gate drive signal to the gate driver 13. The gate driver 13, in the normal mode, applies scan voltages (gate signals) to the gate signal lines G1, G2, . . . , Gn in array order from top to bottom based on the gate drive signal, thereby sequentially turning on the thin film transistors Q of the corresponding gate signal lines G1, G2, . . . , Gn. The gate driver 13, in the standby mode, applies the scan voltages (gate signals) to the gate signal lines G1, G2, . . . , Gn in different order from the array order based on the gate drive signal, to thereby turning on the thin film transistors Q of the corresponding gate signal lines G1, G2, . . . , Gn.

The signal processor 22, in the normal mode, outputs an image control signal to the source driver 14 based on the input image signal, thereby controlling the source driver 14. The source driver 14 applies voltages (source signals) corresponding to the input image signal to the pixel electrodes R, G, B corresponding to the gate signal lines G1, G2, . . . , Gn selected by the gate driver 13 (i.e., the thin film transistors Q of which are turned on) via the source signal lines S1, S2, . . . , Sm. This allows the voltages corresponding to the input image signal to be applied to the pixels (liquid crystals) of the pixel electrodes R, G, B, so that transmittance of the pixels (liquid crystals) of the pixel electrodes R, G, B are controlled.

In the normal mode, as a result of completion of the application of the source signals to the gate signal lines G1, G2, . . . , Gn from top to bottom by the gate driver 13 and the source driver 14, the image data corresponding to the input image signal is written once in all the pixels. The writing of the image data in all the pixels generates an image of one frame. The liquid crystal display panel 12 is a hold type display portion, which holds the written image data for one frame period until the writing of the subsequent image data. An IPS (In Plane Switching) type, a VA (Vertical Alignment) type, or any other types may be applied to the liquid crystal display panel 12.

The backlight controller 23 controls lighting and extinguishing of the backlight portion 15. The backlight controller 23 causes the backlight portion 15 to repeat the lighting and extinguishing at the same frequency as the first frame frequency F1 regardless of the frame frequency.

Figure 3:
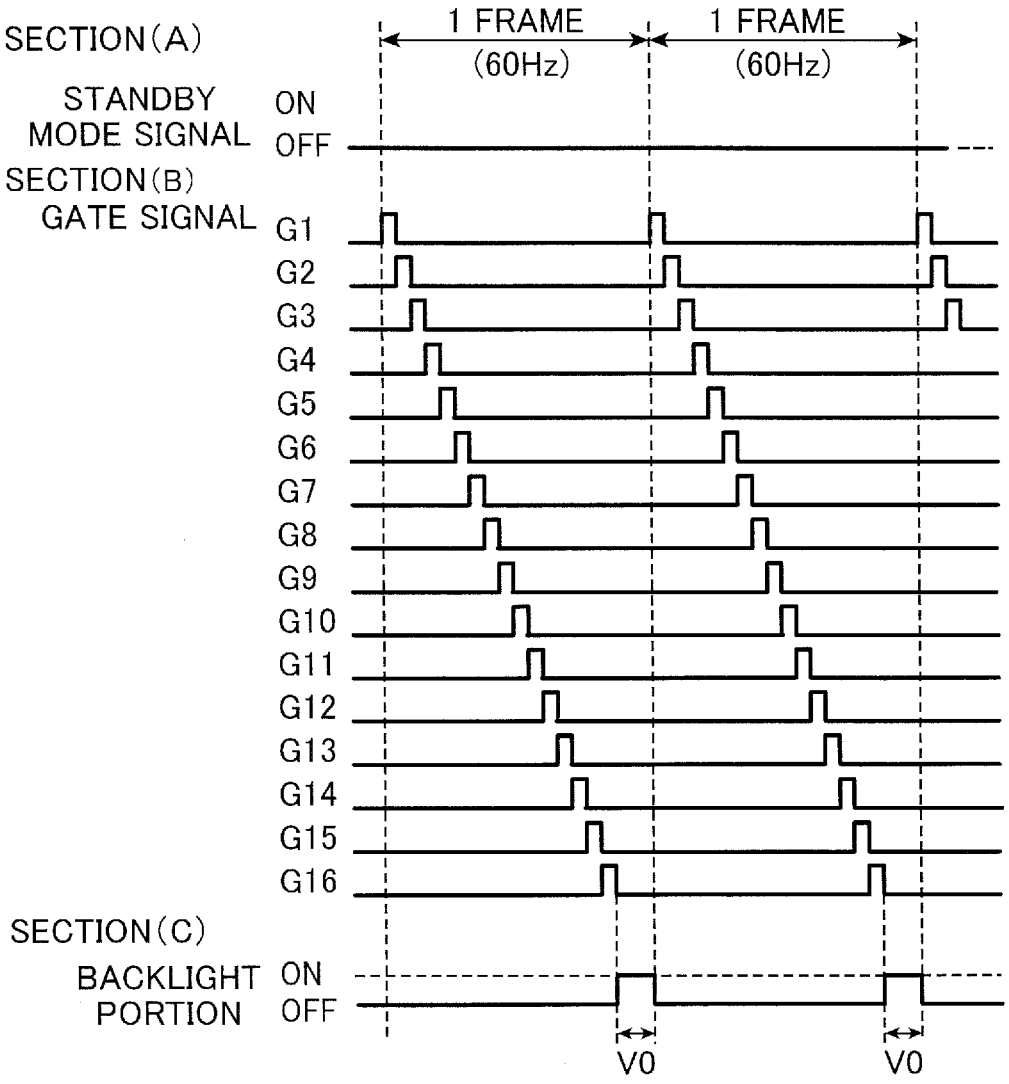
FIG. 3 is a timing chart schematically showing an operation in the normal mode.

FIG. 3 is a timing chart schematically showing an operation in the normal mode. In FIG. 3, section (A) indicates the standby mode signal, section (B) indicates output timing of the gate signals, and section (C) indicates the lighting and extinguishing of the backlight portion 15. In FIG. 3, the number n of the gate signal lines is 16. The operation in the normal mode will be described with reference to FIGS. 1 to 3.

As shown in section (A) of FIG. 3, when the standby mode signal is off, the controller 11 performs control in the normal mode. In the normal mode, the frame frequency is set to the first frame frequency F1 (in this implementation, F1=60 Hz). Moreover, in the normal mode, the gate signals are outputted to the gate signal lines G1 to G16 in the array order from top to bottom based on the gate drive signal outputted from the drive controller 21, as shown in section (B) of FIG. 3. The backlight portion 15 is extinguished during output of the gate signals and is lit in a vertical blanking period V0 after the output of the gate signals by control of the backlight controller 23. That is, the backlight portion 15 repeats the lighting and extinguishing at the same frequency as the first frame frequency F1 (i.e., 60 Hz). In this manner, the backlight portion 15 is extinguished during the output of the gate signals, and is lit after the end of the output of the gate signals, that is, after the end of output of the source signals. This can enhance the display quality of the image as compared with a case where the backlight portion is lit during the output of the source signals.

Figure 4:
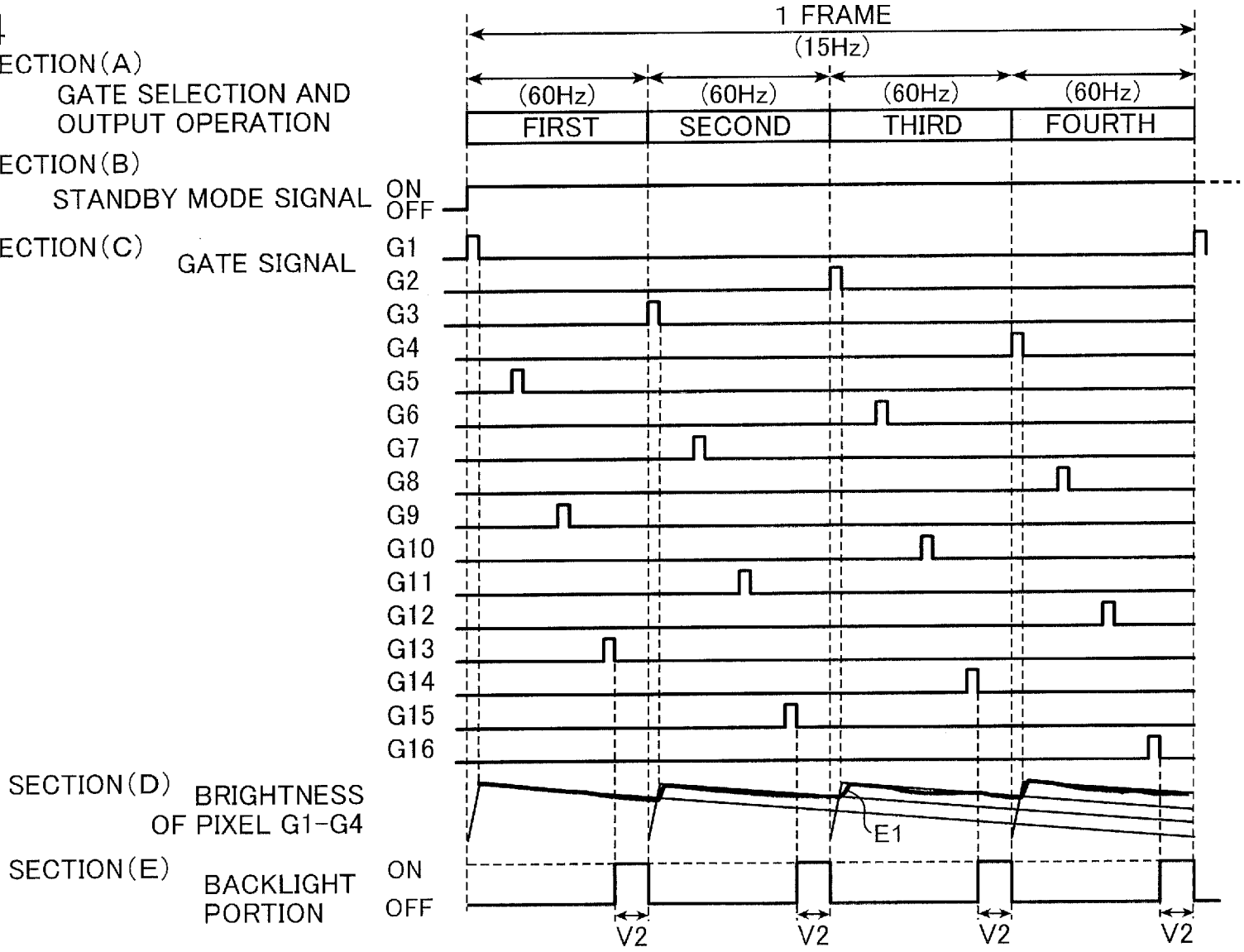
FIG. 4 is a timing chart schematically showing an operation in the standby mode.
Figure 5:
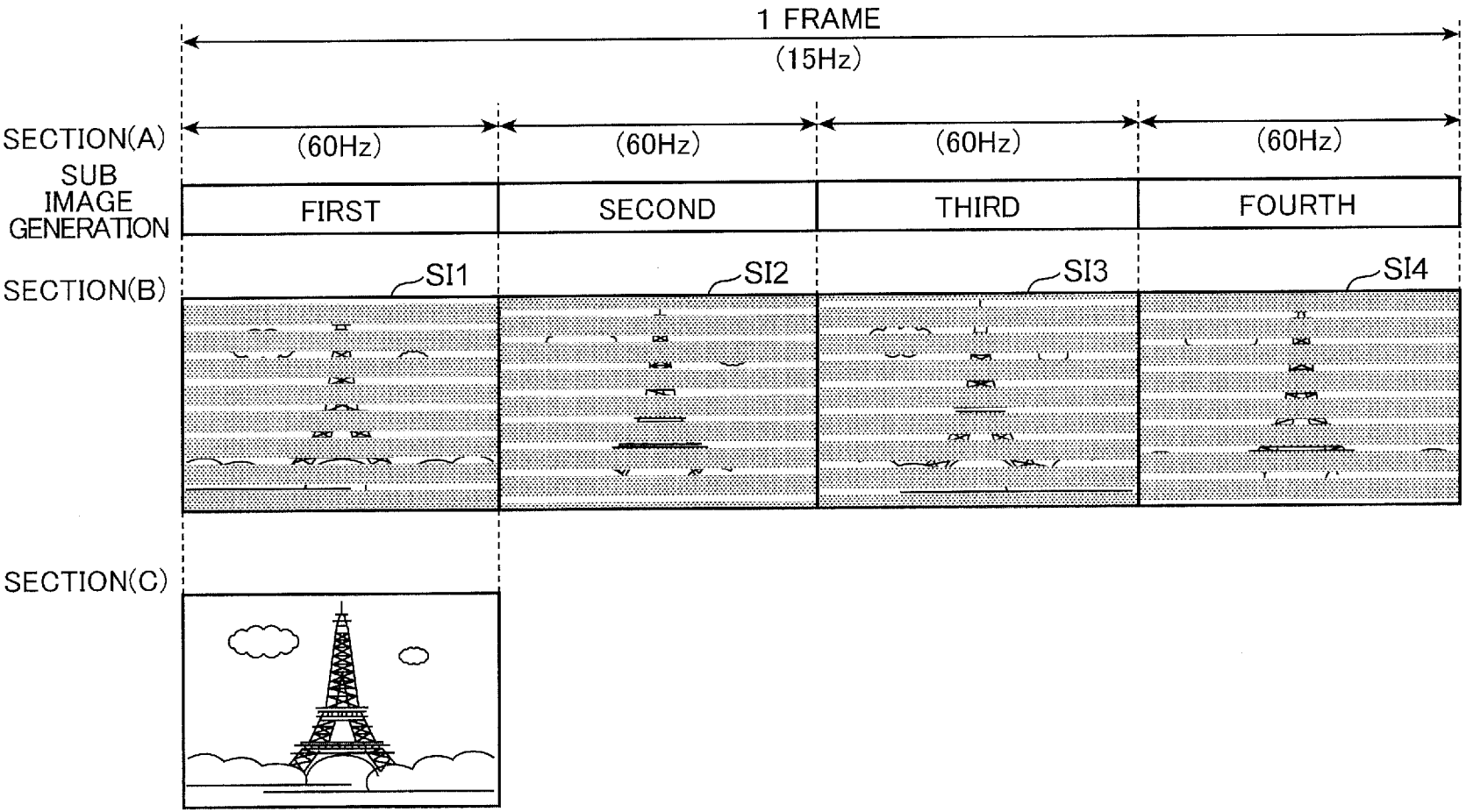
FIG. 5 is a diagram schematically showing images displayed on the liquid crystal display panel.
Figure 11:
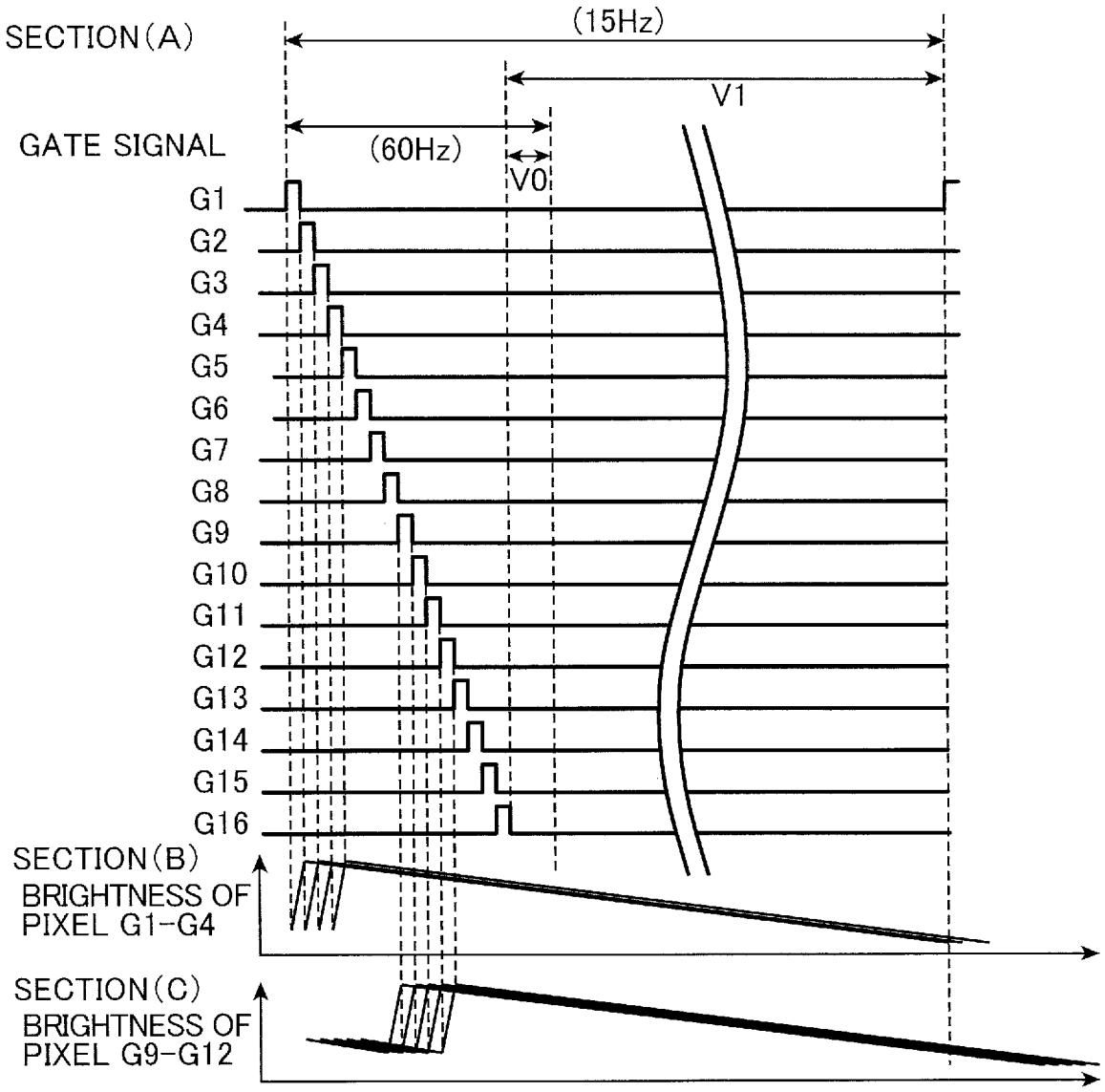
FIG. 11 is a timing chart schematically showing the gate signals and the brightness when the frame frequency is lowered by expanding the vertical blanking period.
Figure 12:
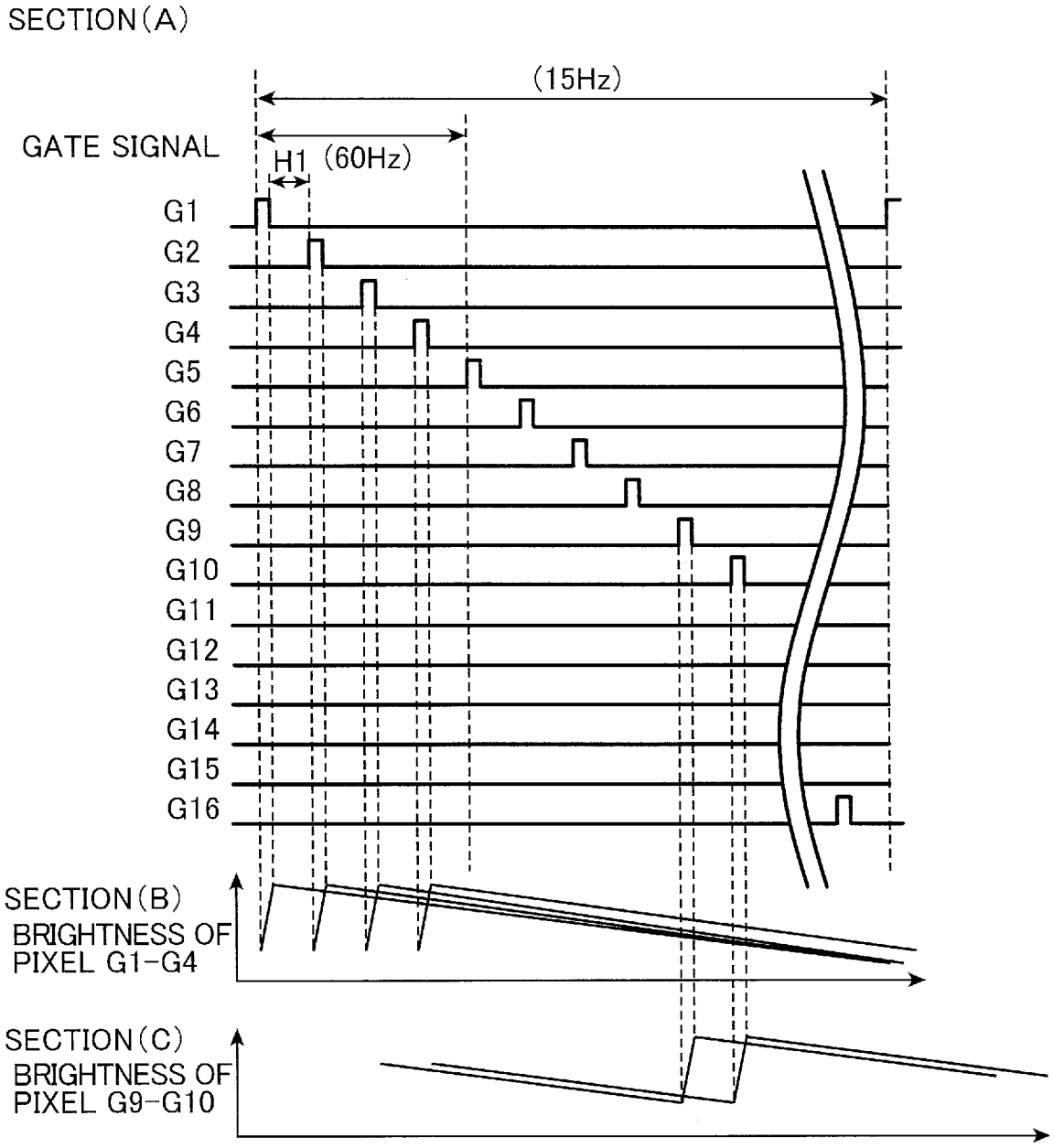
FIG. 12 is a timing chart schematically showing the gate signals and the brightness when the frame frequency is lowered by providing the horizontal blanking period.

FIG. 4 is a timing chart schematically showing an operation in the standby mode. In FIG. 4, section (A) indicates the number of times of a gate selection and output operation, and section (B) indicates the standby mode signal, section (C) indicates output timing of the gate signals, section (D) indicates brightness of the pixels of the gate signal lines G1 to G4, and a section (E) indicates the lighting and extinguishing of the backlight portion 15. In FIG. 4, the number n of the gate signal lines is 16. FIG. 5 is a diagram schematically showing images displayed on the liquid crystal display panel 12. In FIG. 5, section (A) indicates the number of times of sub image generation, section (B) indicates images displayed on the liquid crystal display panel 12 by the operation of FIG. 4, and section (C) indicates an image displayed on the liquid crystal display panel 12 by operation of FIG. 11 as a comparative example. The operation in the standby mode will be described with reference to FIGS. 1 to 5.

As shown in section (B) of FIG. 4, when the standby mode signal is on, the controller 11 performs the control in the standby mode. In the standby mode, images are displayed at a second frame frequency F2 (in this implementation, F2=15 Hz). At this time, as shown in FIG. 4, the gate signals are outputted to the gate signal lines G1 to G16 in different order from the array order of the gate signal lines.

The signal lines G1 to G16 are virtually divided into a plurality of gate groups, each group including K gate signal lines in the array order of the gate signal lines. When the frame frequency is the second frame frequency F2 (in this implementation, F2=15 Hz), the gate driver 13 repeats the gate selection and output operation K time, in which each one of the gate signal lines is selected from the K gate signal lines included in each of the gate groups and the gate signals are outputted to the selected gate signal lines sequentially. Here, F1/F2=K. In this implementation, since F1=60 Hz and F2=15 Hz, K=4.

In FIG. 4, in the first gate selection and output operation, the gate driver 13 selects the gate signal line G1 from the gate group including the gate signal lines G1 to G4, the gate signal line G5 from the gate group including the gate signal lines G5 to G8, the gate signal line G9 from the gate group including the gate signal lines G9 to G12, and the gate signal line G13 from the gate group including the gate signal lines G13 to G16. The gate driver 13 outputs the gate signals to the selected gate signal lines G1, G5, G9, G13 sequentially.

The source driver 14 outputs the source signals in synchronization with the output of the gate signals to the gate signal lines G1, G5, G9, G13 in the first gate selection and output operation. This generates a first sub image SI1 as shown in section (B) of FIG. 5. As shown in section (A) of FIGS. 4 and 5, the sub image generations are performed in response to the gate selection and output operations, and are executed at the frequency 60 Hz, respectively.

In the second gate selection and output operation, the gate driver 13 selects the gate signal line G3 from the gate group including the gate signal lines G1 to G4, the gate signal line G7 from the gate group including the gate signal lines G5 to G8, the gate signal line G11 from the gate group including the gate signal lines G9 to G12, and the gate signal line G15 from the gate group including the gate signal lines G13 to G16. The gate driver 13 outputs the gate signals to the selected gate signal lines G3, G7, G11, G15 sequentially.

The source driver 14 outputs the source signals in synchronization with the output of the gate signals to the gate signal lines G3, G7, G11, G15 in the second gate selection and output operation. This generates a second sub image SI2 as shown in section (B) of FIG. 5.

In the third gate selection and output operation, the gate driver 13 selects the gate signal line G2 from the gate group including the gate signal lines G1 to G4, the gate signal line G6 from the gate group including the gate signal lines G5 to G8, the gate signal line G10 from the gate group including the gate signal lines G9 to G12, and the gate signal line G14 from the gate group including the gate signal lines G13 to G16. The gate driver 13 outputs the gate signals to the selected gate signal lines G2, G6, G10, G14 sequentially.

The source driver 14 outputs the source signals in synchronization with the output of the gate signals to the gate signal lines G2, G6, G10, G14 in the third gate selection and output operation. This generates a third sub image SI3 as shown in section (B) of FIG. 5.

In the fourth gate selection and output operation, the gate driver 13 selects the gate signal line G4 from the gate group including the gate signal lines G1 to G4, the gate signal line G8 from the gate group including the gate signal lines G5 to G8, the gate signal line G12 from the gate group including the gate signal lines G9 to G12, and the gate signal line G16 from the gate group including the gate signal lines G13 to G16. The gate driver 13 outputs the gate signals to the selected gate signal lines G4, G8, G12, G16 sequentially.

The source driver 14 outputs the source signals in synchronization with the output of the gate signals to the gate signal lines G4, G8, G12, G16 in the fourth gate selection and output operation. This generates a fourth sub image SI4 as shown in section (B) of FIG. 5.

By the first to fourth gate selection and output operations, the gate signals are outputted to all the gate signal lines G1 to G16 in the one frame period as shown in section (C) of FIG. 4. By first to fourth sub image generation operations, the same frame image as the frame image shown in section (C) of FIG. 5 is generated in the one frame period at the second frame frequency F2 (in this implementation, F2=15 Hz), as shown in section (B) of FIG. 5.

The backlight portion 15 is lit by the control of the backlight controller 23 after the end of the output of the gate signals to all the gate signal lines in each of the first to fourth gate selection and output operations, as shown in section (E) of FIG. 4. That is, in the first gate selection and output operation, the backlight portion 15 is lit in synchronization with the end of the output of the gate signal to the gate signal line G13, and is extinguished at the end of the period of the first gate selection and output operation after a period V2. Moreover, in the second gate selection and output operation, the backlight portion 15 is lit in synchronization with the end of the output of the gate signal to the gate signal line G15, and is extinguished at the end of the period of the second gate selection and output operation after the period V2.

Moreover, in the third gate selection and output operation, the backlight portion 15 is lit in synchronization with the end of the output of the gate signal to the gate signal line G14, and is extinguished at the end of the period of the third gate selection and output operation after the period V2. In the fourth gate selection and output operation, the backlight portion 15 is lit in synchronization with the end of the output of the gate signal to the gate signal line G16, and is extinguished at the end of the period of the fourth gate selection and output operation after the period V2. In this manner, the backlight portion 15 repeats the lighting and extinguishing at the same frequency as the first frame frequency F1 (i.e., 60 Hz) in the standby mode as well. That is, the backlight portion 15 is lit after each end of the output of the source signals corresponding to the respective sub images SI1 to SI4. This can suppress deterioration in the display quality of the respective sub images SI1 to SI4 as compared with the case where the backlight portion 15 is lit during output of the source signals.

Figure 6:
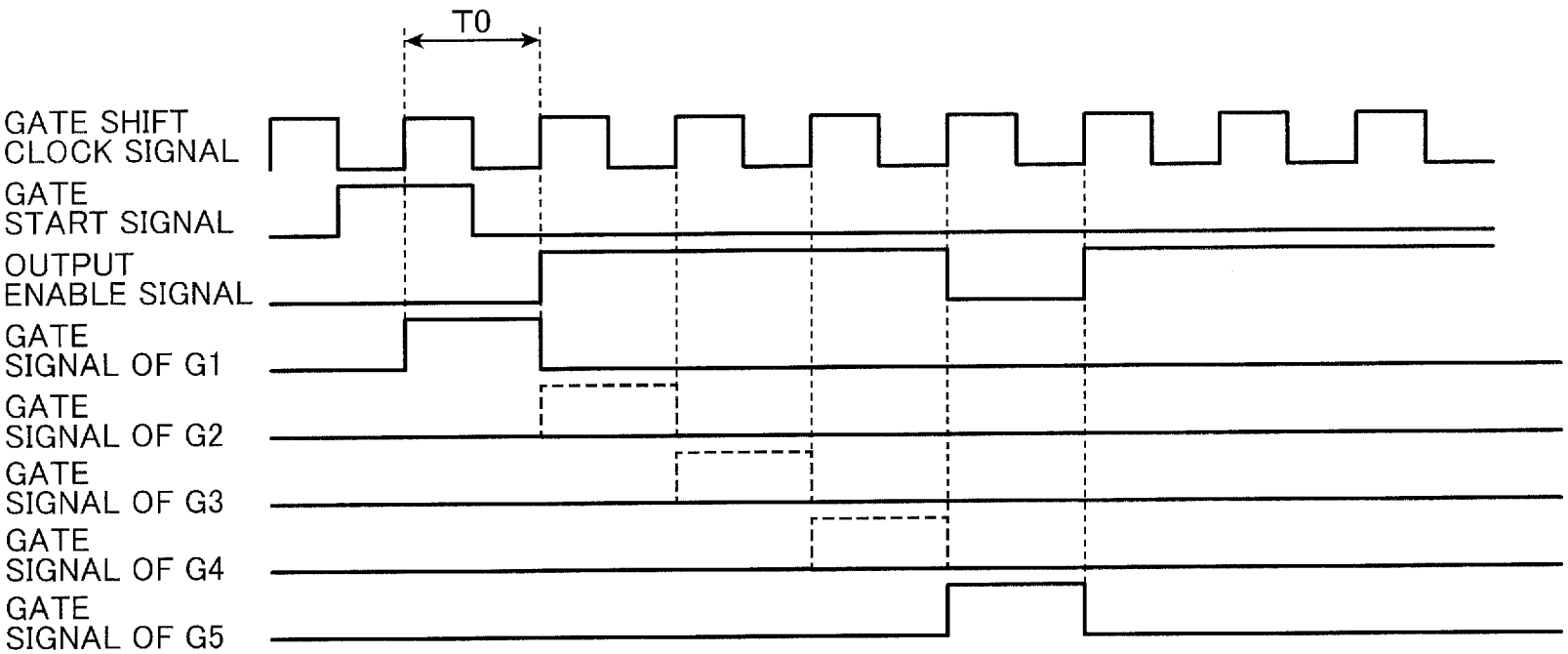
FIG. 6 is a timing chart schematically showing the gate drive signal outputted from the drive controller to the gate driver, and the gate signals outputted from the gate driver to the gate signal lines.

FIG. 6 is a timing chart schematically showing the gate drive signal outputted from the drive controller 21 to the gate driver 13, and the gate signals outputted from the gate driver 13 to the gate signal lines G1 to G5. Output operation of the gate signals in the standby mode will be described with reference to FIGS. 1, 4 and 6.

The drive controller 21 outputs a gate shift clock signal, a gate start signal, and an output enable signal as the gate drive signal to the gate driver 13, as shown in FIG. 6. The output enable signal outputted from the drive controller 21 is a signal that enables the gate signals to be outputted from the gate driver 13. That is, when the output enable signal is at a low level, the gate signals are outputted to the gate signal lines from the gate driver 13. On the other hand, when the output enable signal is at a high level, the gate signals are masked, so that the gate signals are not outputted to the gate signal lines from the gate driver 13.

In FIG. 6, the gate shift clock signal is outputted with a period of one horizontal period T0. The gate signal of the gate signal line G1 becomes at a high level in a width of the one horizontal period T0 until the subsequent gate shift clock signal in synchronization with the gate shift clock signal, when the gate start signal is at a high level. The gate signals shift from the gate signal line G1 to the gate signal line G5 in synchronization with the gate shift clock signal as indicated by dashed lines (the gate signal lines G2 to G4) and solid lines (the gate signal lines G1 and G5) in FIG. 6.

As shown in FIG. 6, at the gate signal output timing of the gate signal lines G1 and G5, the output enable signal is set to the low level, and at the gate signal output timing of the gate signal lines G2 to G4, the output enable signal is set to the high level. Accordingly, the gate signals of the gate signal lines G2 to G4 are masked by the output enable signal, and actually, are not outputted. In this manner, the drive controller 21 controls the output of the gate signals from the gate driver 13 to the gate signal lines by the output enable signal.

In the first gate selection and output operation, the output of the gate signals to the gate signal lines G2 to G4, G6 to G8, G10 to G12, G14 to G16 is masked by the output enable signal, so that only the gate signals to the gate signal lines G1, G5, G9, G13 are outputted, as shown in section (C) of FIG. 4. Moreover, in the second gate selection and output operation, the output of the gate signals to the gate signal lines G1, G2, G4 to G6, G8 to G10, G12 to G14, G16 is masked by the output enable signal, so that only the gate signals to the gate signal lines G3, G7, G11, G15 are outputted, as shown in section (C) of FIG. 4.

In the third gate selection and output operation, the output of the gate signals to the gate signal lines G1, G3 to G5, G7 to G9, G11 to G13, G15 to G16 is masked by the output enable signal, so that only the gate signals to the gate signal lines G2, G6, G10, G14 are outputted, as shown in section (C) of FIG. 4. In the fourth gate selection and output operation, the output of the gate signals to the gate signal lines G1 to G3, G5 to G7, G9 to G11, G13 to G15 is masked by the output enable signal, so that only the gate signals to the gate signal lines G4, G8, G12, G16 are outputted, as shown in section (C) of FIG. 4.

As a result, as shown in section (D) of FIG. 4, the brightness of the pixels of the gate signal line G1 rises at the start time of the first gate selection and output operation, and then gradually decreases. Moreover, the brightness of the pixels of the gate signal line G2 rises at the start time of the third gate selection and output operation, and then gradually decreases. The brightness of the pixels of the gate signal line G3 rises at the start time of the second gate selection and output operation, and then gradually decreases. The brightness of the pixels of the gate signal line G4 rises at the start time of the fourth gate selection and output operation, and then gradually decreases.

In this implementation, when brightness of a region of the gate signal lines G1 to G4 is considered, fluctuation in an envelope E1 of the brightness of the region of the gate signal lines G1 to G4, which is indicated by a thick line, is small. Accordingly, the flicker caused by brightness fluctuation in the region of the gate signal lines G1 to G4 may become inconspicuous. Similarly, the flicker caused by the brightness fluctuation in the region of the gate signal lines G5 to G8, in the region of the gate signal lines G9 to G12, and in the region of the gate signal lines G13 to G16 also may become inconspicuous. As a result, the flicker may become inconspicuous in the whole display screen.

Figure 7:
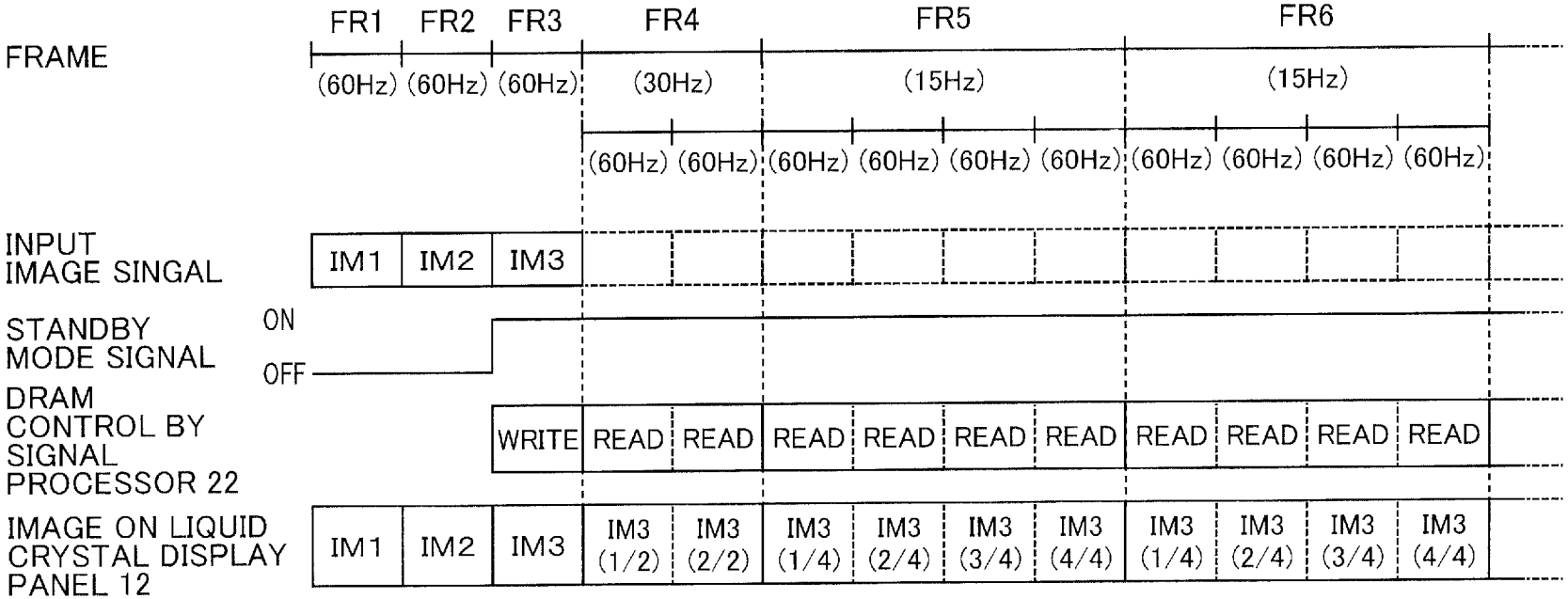
FIG. 7 is a diagram schematically showing a generation method of the image control signal outputted from the signal processor to the source driver.
Figure 8:
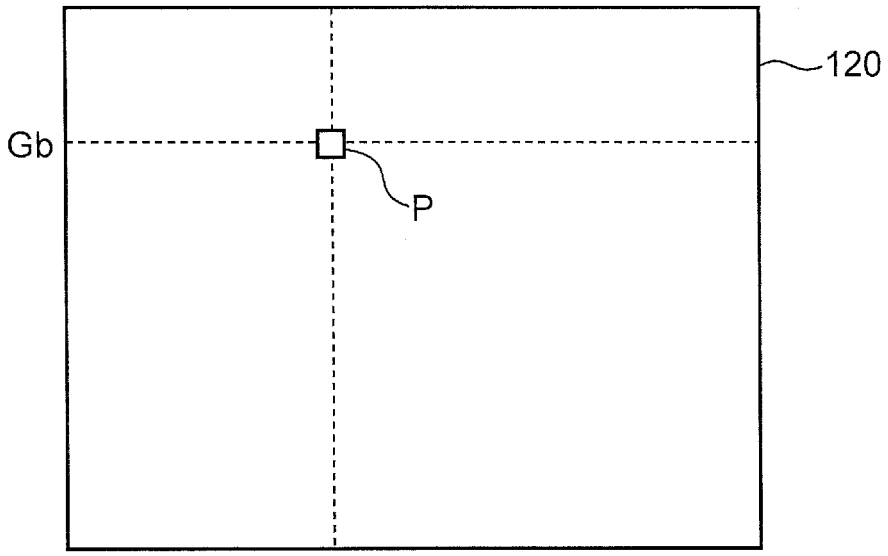
FIG. 8 is a diagram schematically showing the pixel corresponding to the gate signal line in a display screen.
Figure 9:
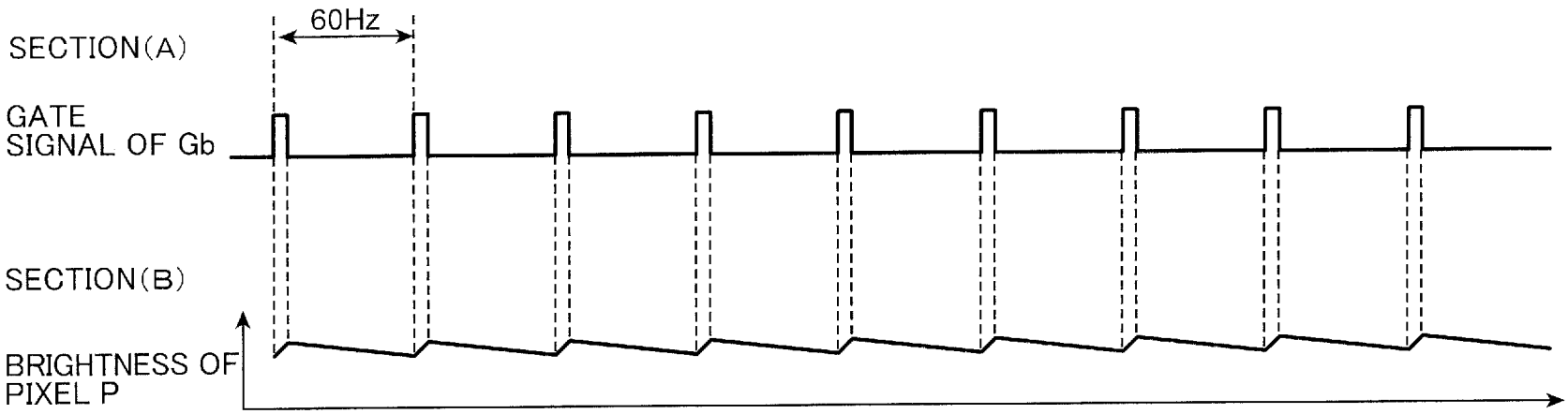
FIG. 9 is a timing chart schematically showing the brightness of the pixel when the frame frequency is 60 Hz.
Figure 10:
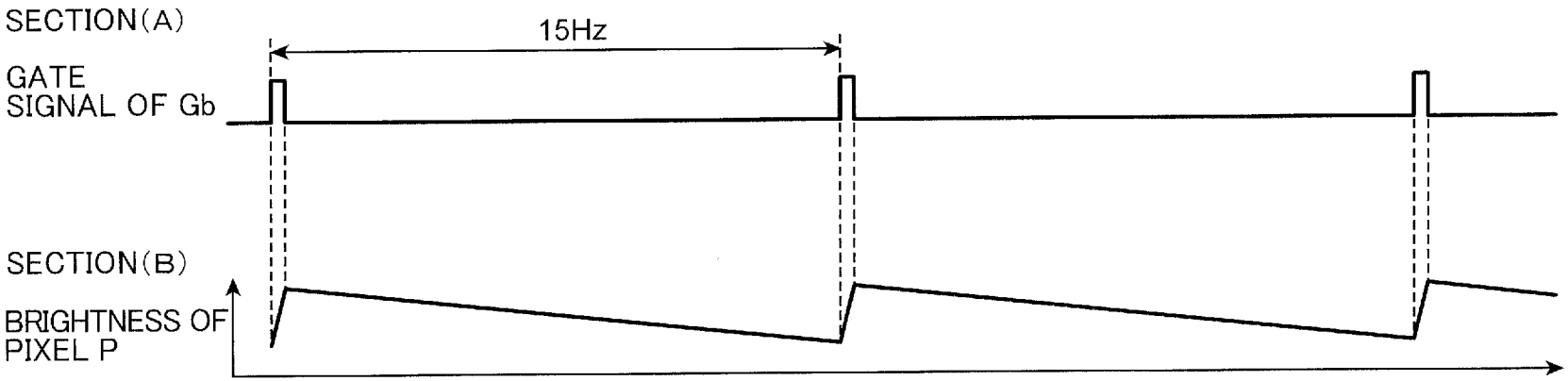
FIG. 10 is a timing chart schematically showing the brightness of the pixel when the frame frequency is 15 Hz.

FIG. 7 is a diagram schematically showing a generation method of the image control signal outputted from the signal processor 22 to the source driver 14. Operations in the normal mode and in the standby mode will be further described with reference to FIGS. 1, 5, 7.

In FIG. 7, it is assumed that in frames FR1, FR2, images IM1, IM2 represented by the input image signal inputted externally are moving pictures. In this case, since the standby mode signal is off, the operation is in the normal mode. That is, in the frames FR1, FR2, the signal processor 22 generates the image control signal based on the input image signal inputted externally, and outputs the generated image control signal to the source driver 14, causing the liquid crystal display panel 12 to display the images IM1, IM2 represented by the input image signal.

It is assumed that in a subsequent FR3, an image IM3 represented by the input image signal inputted externally is a still picture. As with the frames FR1, FR2, the signal processor 22 generates the image control signal based on the external input image signal, and outputs the generated image control signal to the source driver 14, causing the liquid crystal display panel 12 to display the image IM3 represented by the input image signal. When the image IM3 represented by the input image signal inputted externally is a still picture, the standby mode signal inputted externally is switched on. When the standby mode signal is switched on, the signal processor 22 writes data representing the image IM3 in the DRAM 16.

In a subsequent FR4, the standby mode signal is turned on, and the input of the external input image signal is stopped. In the frame FR4, the signal processor 22 reads the data representing the image IM3 stored in the DRAM 16, generating the image control signal based on the read data.

The controller 11 displays the images at the second frame frequency F2 (in this implementation, F2=15 Hz) in the standby mode, as described above. However, the controller 11 does not directly change the frame frequency from the first frame frequency F1 (in this implementation F1=60 Hz) in the normal mode to the second frame frequency F2 when the operation is switched from the normal mode to the standby mode. That is, the controller 11 once shifts the frame frequency from the first frame frequency F1 (in this implementation F1=60 Hz) to an intermediate frame frequency F3 (in this implementation F3=30 Hz), and then shifts the same from the intermediate frame frequency F3 to the second frame frequency F2.

In the intermediate frame frequency F3 (in this implementation, F3=30 Hz), the gate signal lines G1 to Gm are virtually divided into intermediate gate groups each including the L gate signal lines. Here, F1/F3=L. In this implementation, since F1=60 Hz and F3=30 Hz, L=2.

In the intermediate frame frequency F3, in the first gate selection and output operation, for instance, the gate signal lines G1, G3 are selected to output the gate signals. In response to the first gate selection and output operation, the first sub image generation operation is performed, so that the image IM3 (1/2) is displayed on the liquid crystal display panel 12.

In the subsequent second gate selection and output operation, for instance, the gate signal lines G2, G4 are selected to output the gate signals. In response to the second gate selection and output operation, the second sub image generation operation is performed, so that the image IM3 (2/2) is displayed on the liquid crystal display panel 12. The second sub image generation operation allows the image IM3 to be displayed on the liquid crystal display panel 12 at the intermediate frame frequency F3.

In a subsequent frame FR5, the frame frequency is switched from the intermediate frame frequency F3 to the second frame frequency F2. In the frame FR5, as described with reference to FIGS. 4 and 5, the gate selection and output operations and the sub image generation operations are executed. That is, the first sub image generation operation is performed in response to the first gate selection and output operation, so that the image IM3 (1/4) is displayed on the liquid crystal display panel 12.

Moreover, the second sub image generation operation is performed in response to the second gate selection and output operation, so that the image IM3 (2/4) is displayed on the liquid crystal display panel 12. Moreover, the third sub image generation operation is performed in response to the third gate selection and output operation, so that the image IM3 (3/4) is displayed on the liquid crystal display panel 12. The fourth sub image generation operation is performed in response to the fourth gate selection and output operation, so that the image IM3 (4/4) is displayed on the liquid crystal display panel 12.

The above-described images IM3 (1/4), IM3 (2/4), IM3 (3/4), IM3 (4/4) in FIG. 7 correspond to the sub images SI1, SI2, SI3, SI4 indicated in section (B) of FIG. 5, respectively. In a subsequent frame FR6, an operation similar to that of the frame FR5 is performed. In the present implementation, the liquid crystal display panel 12 corresponds to one example of a display portion, the DRAM 16 corresponds to one example of storage, and the main scanning direction corresponds to one example of a first direction, and the sub scanning direction corresponds to one example of a second direction.

As described above, according to this implementation, each one of the gate signal lines is selected sequentially from each of the gate groups virtually divided so as to each include the K (in this implementation, K=4) gate signal lines in the array order of the gate signal lines in the sub scanning direction. This allows the gate signals to be outputted in different order from the array order of the gate signal lines. Accordingly, a fluctuation range of the brightness of the pixels in the region of each of the gate groups each including the K gate signal lines is reduced. As a result, even if the frame frequency is the second frame frequency F2 lower than the first frame frequency F1, the flicker can be made inconspicuous.

Moreover, in this implementation, if the standby mode signal inputted externally is turned on, the data representing the image is stored in the DRAM 16, and in the standby mode, the input of the external input image signal is stopped. The data of the DRAM 16 is read, and the still picture is displayed on the liquid crystal display panel 12. Accordingly, power consumption of the whole system including external devices and the display device 1 can be reduced.

(Others)

In the above-described implementation, the second frame frequency F2 is 15 Hz, but another value may be employed. For instance, F2=12 Hz may be set. In this case, K=F1/F2=5. Accordingly, five sub image generation operations are performed in response to the five gate selection and output operations, thereby displaying the frame image at the frame frequency F2. In the case of F2=12 Hz, as the intermediate frame frequency, after shifting from the first frame frequency F1 to an intermediate frame frequency F31=30 Hz, the frame frequency may further shift to an intermediate frame frequency F32=15 Hz, and then shift to the second frame frequency F2=12 Hz.

Alternatively, for instance, F2=10 Hz may be employed. In this case, K=F1/F2=6. Accordingly, six sub image generation operations are performed in response to the six gate selection and output operations, thereby displaying the frame image at the frame frequency F2. In the case of F2=10 Hz, as the intermediate frame frequency, after shifting from the first frame frequency F1 to the intermediate frame frequency F31=30 Hz, the frame frequency may further shift to the intermediate frame frequency F32=15 Hz, still further shift to an intermediate frame frequency F33=12 Hz, and then shift to the second frame frequency F2=10 Hz.

In the above-described implementation, for instance, the gate selection and output operations are performed in the order of the gate signal lines G1, G3, G2, G4 in the gate group including the gate signal lines G1 to G4, as shown in section (C) of FIG. 4. In other words, the gate signal lines are selected in the different order from the array order of the gate signal lines in the gate group. However, the gate signal lines may be selected from the gate signal lines in the array order of the gate signal lines. That is, for instance, the gate selection and output operations may be performed in the order of the gate signal lines G1, G2, G3, G4 in the gate group including the gate signal lines G1 to G4.

In this modification, for instance, in the first gate selection and output operation, the gate signals are outputted in the order of the gate signal lines G1, G5, G9, G13, and for instance, in the second gate selection and output operation, the gate signals are outputted in the order of the gate signal lines G2, G6, G10, G14. That is, in this modification as well, since the gate signals are outputted in different order from the array order of the gate signal lines G1 to G16, an effect similar to that in the above-described implementation can be obtained.

In the above-described implementation, for instance, the gate selection and output operations are performed in the order of the gate signal lines G1, G3, G2, G4 in the gate group including the gate signal lines G1 to G4, as shown in section (C) of FIG. 4. That is, in the gate group, the first gate signal line G1 is selected in the first gate selection and output operation, and the fourth (K-th) gate signal line G4 is selected in the fourth (K-th) gate selection and output operation, which indicates that the gate signal lines are selected in the array order. Moreover, in the gate group, the third gate signal line G3 is selected in the second gate selection and output operation, and the second gate signal line G2 is selected in the third gate selection and output operation, which indicates that the gate signal lines are selected in the different order from the array order. In other words, in the first and last gate selection and output operations, the gate signal lines are selected in the array order. Accordingly, there is an advantage that the control of the gate selection and output operations can be easily understood.

In the above-described implementation, when the standby mode signal inputted externally is turned on, the operation is switched from the normal mode to the standby mode. However, in place of the standby mode signal, a still picture determiner that determines whether or not the input image signal represents a still picture may be included, and the operation may be switched from the normal mode to the standby mode by using a result of the still picture determination. For instance, the still picture determiner may determine whether the input image signal is a still picture or a moving picture by performing a comparison of the input image signal for each of the pixels between the different frames based on the input image signal. In this configuration as well, an effect similar to that of the above-described implementation can be obtained.

Moreover, in the above-described display device 1, the liquid crystal display panel 12 is included as the display portion, but the display portion is not limited to the liquid crystal display panel 12. The above-described display device 1 may include, for instance, a voltage driving organic EL display panel as the display portion. Since in the voltage driving organic EL display panel, voltage easily leaks and decreases after the voltage is applied, the application of the above-described implementation can preferably suppress excessive deterioration in display quality of the image. That is, the display portion can be a display portion, the brightness of which may easily decrease when the frame frequency is lowered in displaying the frame image. Note that the specific implementations described above mainly include the illustrative implementations having the following configuration.

In one general aspect, the instant application describe a display device that includes a display portion having a plurality of gate signal lines extending in a first direction and aligned in a second direction intersecting the first direction, a plurality of source signal lines extending in the second direction and aligned in the first direction, and a plurality of pixels connected to the source signal lines and the gate signal lines. The display portion is configured to display an image at a frame frequency for each frame. The display device further includes a gate driver configured to output gate signals to the gate signal lines sequentially and a source driver configured to output source signals to the pixels connected to the gate signal lines to which the gate signals are outputted, the source signals configured to display the image through the source signal lines. The display device further includes a controller configured to control the gate driver and the source driver to cause the display portion to display the image at the frame frequency for each frame. The controller sets the frame frequency to a first frame frequency F1 when the image is a moving picture, and the controller sets the frame frequency to a second frame frequency F2 lower than the first frame frequency F1 when the image is a still picture. The gate driver outputs the gate signals to the gate signal lines in the aligned order of the gate signal lines in the second direction when the frame frequency is the first frame frequency F1. The gate driver outputs the gate signals to the gate signal lines in a different order from the aligned order when the frame frequency is the second frame frequency F2.

According to this configuration, when the image is a moving picture, the frame frequency is set to the first frame frequency F1, and when the image is a still picture, the frame frequency is set to the second frame frequency F2 lower than the first frame frequency F1. When the frame frequency is the first frame frequency F1, the gate signals are outputted to the gate signal lines in the aligned order of the gate signal lines in the second direction. Moreover, when the frame frequency is the second frame frequency F2, the gate signals are outputted to the gate signal lines in the different order from the aligned order.

Here, in the case of the second frame frequency F2, when the gate signals are outputted to the gate signal lines in the aligned order of the gate signal lines in the second direction, output intervals of the source signals outputted to the respective pixels for each frame may be increased as compared with the case of the first frame frequency F1. This may bring about a decrease in the brightness of the respective pixels due to, for instance, voltage leakage from the pixels until the subsequent source signal is outputted, as compared with the case of the first frame frequency F1. At this time, if the gate signals are outputted to the gate signal lines in the aligned order of the gate signal lines in the second direction, the source signals are outputted in the aligned order of the source signal lines. Accordingly, in the whole display portion, the brightness of the pixels may be increased in an aligned order thereof, which may make flicker conspicuous, and may deteriorate the quality of the displayed image.

In contrast, in the above-described configuration, when the frame frequency is the second frame frequency F2, the gate signals are outputted to the gate signal lines in a different order from the aligned order of the gate signal lines. Similarly, the source signals are outputted in a different order from the aligned order of the source signal lines. Accordingly, in the whole display portion, the brightness of the pixels may be increased in different order from the aligned order, which may make the flicker inconspicuous. As a result, the excessive deterioration in the quality of the displayed image can be prevented.

The above general aspect may include one or more of the following features. The gate signal lines may be divided into a plurality of gate groups, each group including K (K is an integer of 2 or more) gate signal lines in the aligned order of the gate signal lines. The gate driver may repeat a gate selection and output operation K times when the frame frequency is the second frame frequency F2. The gate selection and output operation may include an operation of selecting each one of the gate signal lines from the K gate signal lines included in each of the gate groups and outputting the gate signals to the selected gate signal lines sequentially, by which the gate signals may be outputted to all the gate signal lines in one frame period. The controller may control the source driver in response to the gate selection and output operation to cause the display portion to display the still picture at the second frame frequency F2 for each frame. Accordingly, repeating the gate selection and output operation K times enables the gate signals to be easily outputted to the gate signal lines in the different order from the aligned order of the gate signal lines. As noted above, the source driver is controlled in response to the gate selection and output operations, by which the still picture is displayed on the display portion at the second frame frequency F2 for each frame. This can prevent excessive deterioration in the display quality of the still picture.

The gate driver may select each one of the gate signal lines in the aligned order of the K gate signal lines, when selecting each one of the gate signal lines from the K gate signal lines included in each of the gate groups in the gate selection and output operation. This enables the gate selection and output operation to be performed by easy control. The gate driver may select each one of the gate signal lines in a different order from the aligned order of the K gate signal lines, when selecting each one of the gate signal lines from the K gate signal lines included in each of the gate groups in the gate selection and output operation. This allows the gate signals to be outputted in more random order than the case where the each one of the gate signal lines is selected in the aligned order of the K gate signal lines. Accordingly, excessive deterioration in the display quality of the still picture can be prevented more effectively.

The gate driver may select half or more than half of the K gate signal lines in the different order from the aligned order, when selecting each one from the K gate signal lines included in each of the gate groups in the gate selection and output operation. This allows the gate signals to be outputted in more random order. Accordingly, excessive deterioration in the display quality of the still picture can be prevented more effectively.

K may be an integer of 4 or more. The gate driver may select the first gate signal line in the aligned order in the first gate selection and output operation and select the K-th gate signal line in the aligned order in the K-th gate selection and output operation. The gate driver may select the gate signal lines in the different order from the aligned order in the second to (K−1)th gate selection and output operations, when selecting each one of the gate signals from the K gate signal lines included in each of the gate groups in the gate selection and output operation. Accordingly, the gate signal lines to which the gate signals are outputted first and last in each of the gate groups are set in the aligned order. This can prevent the control of the gate selection and output operation from being excessively complicated. In the second to (K−1)th gate selection and output operations, the gate signal lines are selected in the different order from the aligned order. This allows the gate signals to be outputted in more random order. As a result, excessive deterioration in the display quality of the still picture can be prevented more effectively.

F2/F1 may be equal to 1/K. The controller may repeat a first sub image operation at the first frame frequency F1 K times. The first sub image operation may include an operation of generating a sub image in each of the gate selection and output operations, and causing the display portion to display the generated sub image, by which the still picture is displayed on the display portion at the second frame frequency F2 for each frame. Accordingly, the still picture can be preferably displayed at the second frame frequency F2.

In one implementation, the controller may switch the frame frequency from the first frame frequency F1 to an intermediate frame frequency F3 (F1>F3>F2) and then, further may switch the frame frequency from the intermediate frame frequency F3 to the second frame frequency F2, when switching an image signal from a moving picture signal to a still picture signal causes the frame frequency to be switched from the first frame frequency F1 to the second frame frequency F2. Accordingly, a switching width of the frame frequency can be reduced, as compared with the case where the frame frequency is directly switched from the first frame frequency F1 to the second frame frequency F2. This can suppress excessive deterioration in the display quality of the image due to the switching of the frame frequency.

K may be an integer of 3 or more. The gate signal lines may be divided into a plurality of intermediate gate groups, each group including L (L is an integer of 2 or more, and less than K) gate signal lines in the aligned order. The gate driver may repeat an intermediate selection and output operation L times. The intermediate selection and output operation may include an operation of selecting each one of the gate signal lines from the L gate signal lines included in each of the intermediate gate groups and outputting the gate signals to the selected gate signal lines sequentially, by which the gate signals are outputted to all the gate signal lines in one frame period, when the frame frequency is the intermediate frame frequency F3. The controller may control the source driver in response to the intermediate selection and output operation to cause the display portion to display the still picture at the intermediate frame frequency F3 for each frame. Accordingly, repeating the intermediate selection and output operation L times enables the gate signals to be easily outputted to the gate signal lines in the different order from the aligned order of the gate signal lines. Furthermore, excessive deterioration in the display quality of the still picture can be suppressed.

F3/F1 may be equal to 1/L. The controller may repeat a second sub image operation at the first frame frequency F1 L times. The second sub image operation may include an operation of generating a sub image in each of the intermediate selection and output operations, and causing the display portion to display the generated sub image, by which the still picture is displayed on the display portion at the intermediate frame frequency F3 for each frame. Accordingly, the still picture can be preferably displayed at the intermediate frame frequency F3.

The display device may include a storage configured to store an image signal. The controller may store a still picture signal in the storage, and may read the still picture signal stored in the storage to cause the display portion to display the still picture at the second frame frequency F2 for each frame based on the read still picture signal, when an input image signal inputted externally is the still picture signal representing the still picture.

According to this configuration, when the input image signal inputted externally is the still picture signal representing the still picture, the still picture signal is stored in the storage. The still picture signal stored in the storage is read to cause the display portion to display the still picture at the second frame frequency F2 for each frame based on the read still picture signal. Accordingly, since the input of the external input image signal is not required, the control of the image display can be simplified.

The display device may include a backlight portion configured to illuminate the display portion from a back surface of the display portion. The controller may further control lighting and extinguishing of the backlight portion. The pixels of the display portion may each include a liquid crystal. The controller may repeat the lighting and extinguishing of the backlight portion at the same frequency as the first frame frequency F1 regardless of the frame frequency. This can simplify the control of the lighting and extinguishing of the backlight portion. Moreover, deterioration in the display quality of the image displayed on the display portion can be suppressed.

A display device of the instant application may be capable of suppressing excessive deterioration in display quality of an image displayed on the display portion of the display device.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A display device comprising:

a display portion including a plurality of gate signal lines extending in a first direction and aligned in a second direction intersecting the first direction, a plurality of source signal lines extending in the second direction and aligned in the first direction, and a plurality of pixels connected to the source signal lines and the gate signal lines, the display portion configured to display an image at a frame frequency for each frame;

a gate driver configured to output gate signals to the gate signal lines sequentially;

a source driver configured to output source signals to the pixels connected to the gate signal lines to which the gate signals are outputted, the source signals configured to display the image through the source signal lines; and a controller configured to control the gate driver and the source driver to cause the display portion to display the image at the frame frequency for each frame, wherein:

the controller sets the frame frequency to a first frame frequency F1 when the image is a moving picture, and the controller sets the frame frequency to a second frame frequency F2 lower than the first frame frequency F1 when the image is a still picture, the controller once switches the frame frequency from the first frame frequency F1 to an intermediate frame frequency F3 (F1>F3>F2) and then, further switches the frame frequency from the intermediate frame frequency F3 to the second frame frequency F2, when switching the image signal from the moving picture signal to the still picture signal causes the frame frequency to be switched from the first frame frequency F1 to the second frame frequency F2, and the gate driver outputs the gate signals to the gate signal lines in an aligned order of the gate signal lines in the second direction when the frame frequency is the first frame frequency F1, and the gate driver outputs the gate signals to the gate signal lines in a different order from the aligned order of the gate signal lines when the frame frequency is the second frame frequency F2.

2. The display device according to claim 1, wherein:

the gate signal lines are divided into a plurality of gate groups, each group including K (K is an integer of 2 or more) gate signal lines in the aligned order, the gate driver repeats a gate selection and output operation K times when the frame frequency is the second frame frequency F2, the gate selection and output operation being an operation of selecting each one of the gate signal lines from the K gate signal lines included in each of the gate groups and outputting the gate signals to the selected gate signal lines sequentially, by which the gate signals are outputted to all the gate signal lines in one frame period, and the controller controls the source driver in response to the gate selection and output operation to cause the display portion to display the still picture at the second frame frequency F2 for each frame.

3. The display device according to claim 2, wherein the gate driver selects each one of the gate signal lines in the aligned order of the K gate signal lines, when selecting each one of the gate signal lines from the K gate signal lines included in each of the gate groups in the gate selection and output operation.

4. The display device according to claim 2, wherein the gate driver selects each one of the gate signal lines in a different order from the aligned order of the K gate signal lines, when selecting each one of the gate signal lines from the K gate signal lines included in each of the gate groups in the gate selection and output operation.

5. The display device according to claim 4, wherein the gate driver selects half or more than half of the K gate signal lines in the different order from the aligned order, when selecting each one of the gate signal lines from the K gate signal lines included in each of the gate groups in the gate selection and output operation.

6. The display device according to claim 5, wherein:

K is an integer of 4 or more, the gate driver selects the first gate signal line in the aligned order in the first gate selection and output operation and selects the K-th gate signal line in the aligned order in the K-th gate selection and output operation, and the gate driver selects the gate signal lines in the different order from the aligned order in the second to (K−1)th gate selection and output operations, when selecting each one of the gate signal lines from the K gate signal lines included in each of the gate groups in the gate selection and output operation.

7. The display device according to claim 1, wherein:

F2/F1=1/K, and the controller repeats a first sub image operation at the first frame frequency F1 K times, the first sub image operation being an operation of generating a sub image in each of the gate selection and output operations, and causing the display portion to display the generated sub image, by which the still picture is displayed on the display portion at the second frame frequency F2 for each frame.

8. The display device according to claim 1, wherein:

K is an integer of 3 or more, the gate signal lines are divided into a plurality of intermediate gate groups, each group including L (L is an integer of 2 or more, and less than K) gate signal lines in the aligned order, the gate driver repeats an intermediate selection and output operation L times, the intermediate selection and output operation being an operation of selecting each one of the gate signal lines from L gate signal lines included in each of the intermediate gate groups and outputting the gate signals to the selected gate signal lines sequentially, by which the gate signals are outputted to all the gate signal lines in one frame period, when the frame frequency is the intermediate frame frequency F3, and the controller controls the source driver in response to the intermediate selection and output operation to cause the display portion to display the still picture at the intermediate frame frequency F3 for each frame.

9. The display device according to claim 8, wherein:

F3/F1=1/L, and the controller repeats a second sub image operation at the first frame frequency F1 L times, the second sub image operation being an operation of generating a sub image in each of the intermediate selection and output operations, and causing the display portion to display the generated sub image, by which the still picture is displayed on the display portion at the intermediate frame frequency F3 for each frame.

10. The display device according to claim 1, further comprising a storage configured to store an image signal, wherein the controller stores a still picture signal in the storage, and reads the still picture signal stored in the storage to cause the display portion to display the still picture at the second frame frequency F2 for each frame based on the read still picture signal, when an input image signal inputted externally is the still picture signal representing the still picture.

11. The display device according to claim 1, further comprising a backlight portion configured to illuminate the display portion from a back surface of the display portion, wherein:

the controller further controls lighting and extinguishing of the backlight portion, the pixels of the display portion each include a liquid crystal, and the controller repeats the lighting and extinguishing of the backlight portion at the same frequency as the first frame frequency F1 regardless of the frame frequency.

* * * * *